US011251551B2

(12) United States Patent
Gruber et al.

(10) Patent No.: US 11,251,551 B2
(45) Date of Patent: Feb. 15, 2022

(54) CONNECTING ELEMENT, ASSEMBLY CONNECTION AND CIRCUIT BOARD ARRANGEMENT

(71) Applicant: Rosenberger Hochfrequenztechnik GmbH & Co. KG, Fridolfing (DE)

(72) Inventors: Andreas Gruber, Ainring (DE); Tobias-Lars Hoeher, Waging am See (DE); Bernhard Aicher, Fridolfing (DE); Moritz Sigler, Waging am See (DE)

(73) Assignee: Rosenberger Hochfrequenztecknik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/574,778

(22) Filed: Sep. 18, 2019

(65) Prior Publication Data

US 2020/0091636 A1 Mar. 19, 2020

(30) Foreign Application Priority Data

Sep. 19, 2018 (EP) ..... 18195460

(51) Int. Cl.
*H01R 12/70* (2011.01)
*H01R 12/71* (2011.01)
(Continued)

(52) U.S. Cl.
CPC ..... *H01R 12/7082* (2013.01); *H01B 13/004* (2013.01); *H01R 12/716* (2013.01);
(Continued)

(58) Field of Classification Search
CPC .... H01R 2103/00; H01R 43/24; H01R 43/18; H01R 31/06; H01R 12/716; H01R 24/40; H01R 24/50; H01R 12/7082; H01R 12/73; H01R 12/91; H01B 13/004; H01B 13/008; H02G 15/025
See application file for complete search history.

(56) References Cited

U.S. PATENT DOCUMENTS 5,175,493 A * 12/1992 Langgard ..... G01R 1/067 324/72.5
7,118,415 B2 10/2006 Konda
(Continued)

FOREIGN PATENT DOCUMENTS

CA 2246400 A1 11/1994
DE 10 2004 032 474 A1 1/2005
(Continued)

*Primary Examiner* — Briggitte R. Hammond
(74) *Attorney, Agent, or Firm* — Donald S. Showalter, Esq.; GrayRobinson, P.A.

(57) ABSTRACT

Embodiments of a connecting element for connecting a first electrical assembly to a second electrical assembly may comprise a rigid, tubular outer housing made of an electrically conductive material and an electrical cable running inside the outer housing along a longitudinal axis of the outer housing. The electrical cable may include at least one inner conductor and a dielectric layer surrounding the at least one inner conductor. At least one segment of the outer housing may be reshaped along the longitudinal axis in such a way as to fix the electrical cable inside the outer housing.

15 Claims, 2 Drawing Sheets

(51) Int. Cl.

| | |
|---|---|
| ***H01R 31/06*** | (2006.01) |
| ***H01R 43/24*** | (2006.01) |
| ***H01R 24/40*** | (2011.01) |
| ***H01R 43/18*** | (2006.01) |
| ***H01B 13/004*** | (2006.01) |
| ***H01R 103/00*** | (2006.01) |

(52) U.S. Cl.
CPC ..... *H01R 24/40* (2013.01); *H01R 31/06* (2013.01); *H01R 43/18* (2013.01); *H01R 43/24* (2013.01); *H01R 2103/00* (2013.01)

(56) References Cited

U.S. PATENT DOCUMENTS

| | | | | |
|---|---|---|---|---|
| 8,827,744 | B2 * | 9/2014 | Poma | H01R 9/0518 439/585 |
| 9,240,656 | B1 * | 1/2016 | Long | H01R 13/6583 |
| 9,819,164 | B2 * | 11/2017 | Ichikawa | B60R 16/0215 |
| 10,008,786 | B2 | 6/2018 | Brantingham | |
| 10,361,496 | B1 | 7/2019 | Weiland et al. | |
| 2005/0159022 | A1 | 7/2005 | Nagata | |
| 2006/0099853 | A1 | 5/2006 | Sattele et al. | |
| 2009/0197433 | A1 | 8/2009 | Hermant et al. | |
| 2015/0270635 | A1 | 9/2015 | Wollitzer et al. | |
| 2015/0311612 | A1 * | 10/2015 | Qiao | H01R 12/716 439/607.01 |
| 2016/0141784 | A1 | 5/2016 | Hashiguchi | |
| 2017/0287596 | A1 * | 10/2017 | De Cet | H01R 9/05 |
| 2018/0301834 | A1 | 10/2018 | Dandl et al. | |

FOREIGN PATENT DOCUMENTS

| | | | |
|---|---|---|---|
| DE | 20 2015 007010 | U1 | 10/2015 |
| EP | 1440834 | A1 | 7/2004 |
| JP | 2006 260898 | A | 9/2006 |

* cited by examiner

CONNECTING ELEMENT, ASSEMBLY CONNECTION AND CIRCUIT BOARD ARRANGEMENT

CROSS REFERENCE TO RELATED APPLICATIONS

Pursuant to 35 U.S.C. § 119, priority is hereby claimed to pending European Patent Application No. 18 195 460.3 which was filed in the European Patent Office on Sep. 19, 2018.

STATEMENT REGARDING FEDERALLY-SPONSORED RESEARCH OR DEVELOPMENT

Not applicable.

INCORPORATION BY REFERENCE

European Patent Application No. 18 195 460.3 is expressly incorporated herein by reference in its entirety to form part of the present disclosure.

FIELD OF INVENTION

The invention relates to the field of electrical connectors, methods of making same and assemblies incorporating same. More particularly, the invention relates to connecting elements and connection assemblies for connecting a first electrical assembly and a second electrical assembly as well as to methods for the manufacture of such connecting elements. A further aspect of the invention relates to a circuit board arrangement for connecting circuit boards to one another by way of such connecting elements.

BACKGROUND

Electrical assemblies usually have electronic circuits that are implemented on circuit boards ("Printed Circuit Boards", PCBs) by interconnecting a plurality of electronic components. Multiple circuit boards are frequently provided within one assembly in order, for example, to distribute a circuit spatially in a housing or enclosure or to connect different modules together into one assembly. As a rule with this construction an electrical connection between the different circuit boards is necessary for an exchange of signals and/or energy. An electrical connection between different circuit boards can, for example, also be necessary if a plurality of electronic assemblies should be connected together for communication. There are, in general, various reasons for connecting multiple electrical circuit boards together Various possibilities are known for the electrical connection of circuit boards, including unscreened plug-in connectors, stranded wire and ribbon cable. Such connections are also known under the name of "board-to-board" connection. The conventional connections are, however, as a rule inadequate, in particular for high-frequency technology In order to connect two circuit boards together electrically, coaxial connecting elements are frequently used for the transmission of signals in high-frequency technology, in order to ensure a sufficiently high signal quality. In practice, a coaxial plug-in connector of the connecting element is connected in each case here to a mating plug-in connector mounted on a circuit board. The mating plug-in connector is preferably soldered to the circuit board, or pressed and connected electrically to striplines of the circuit board. A coaxial intermediate piece, also known as an "adapter", connects the two coaxial plug-in connectors, and thus bridges the distance between the two circuit boards in order to enable the signal exchange.

As a rule, the known coaxial connecting elements comprise an inner conductor and an outer conductor that is electrically insulated by means of an insulation piece or dielectric from the inner conductor, each manufactured as turned parts. As a rule, the manufacture of the components by means of turning is necessary in order to achieve sufficiently good manufacturing tolerances and to enable a press-fit. When, in particular, the connecting element is to be employed for high-frequency technology, the requirements on the manufacturing tolerances are particularly high.

One disadvantage of the known connecting elements is that the comparatively complex manufacture entails a high cost outlay. The known connecting elements are thus generally, in particular, not economically suitable for large-scale manufacture.

BRIEF SUMMARY OF THE INVENTION

The present invention addresses the object of simplifying the construction and the manufacture of a connecting element for connecting a first electrical assembly to a second electrical assembly, in particular while retaining the electrical transmission properties suitable for high-frequency technology.

The present invention further addresses the object of simplifying the construction and the manufacture of an assembly connection for connecting a first electrical assembly to a second electrical assembly, in particular while retaining the electrical transmission properties suitable for high-frequency technology.

The present invention also addresses the object of providing a circuit board arrangement that comprises at least an improved connecting element, in particular from the point of view of an economical manufacture of the connecting element.

A connecting element for connecting a first electrical assembly to a second electrical assembly is provided, comprising a rigid, tubular outer housing made of an electrically conductive material and an electrical cable running inside the outer housing along a longitudinal axis of the outer housing.

The longitudinal axis can, preferably, be an axis of symmetry of the outer housing. Inasmuch as a coaxial cable with an inner conductor is concerned, the longitudinal axis of the outer housing runs coaxially with the longitudinal axis of the inner conductor, or coincides with it, even after reshaping. The longitudinal axis can also be defined in that it is the axis that results when the centers of gravity of the cross-section surfaces of the outer housing are connected to one another.

The outer housing preferably surrounds the electrical cable in the form of a tube.

The connecting element can preferably be of coaxial design in such a way that the longitudinal axes of the electrical cable and of the outer housing are coincident.

The outer housing does not have to be designed to enclose the electrical cable completely, and, in terms of the invention, can also carry the electrical cable within itself even if it has cut-outs, in particular holes and/or slots.

According to the invention the electrical cable comprises at least one inner conductor and a dielectric surrounding the at least one inner conductor.

The at least one dielectric surrounding the inner conductor can, in particular, also be a cable jacket.

The electrical cable can, preferably, also be a "cable blank", i.e. an unfinished electrical cable wherein at least one inner conductor is first overmolded with a surrounding dielectric—whereby further potential manufacturing steps are omitted. It can, in particular, be a cable blank of a coaxial cable in which a coaxial outer conductor (e.g. a cable screen braid and/or a screen foil) and a cable jacket have not yet been mounted on the dielectric surrounding the inner conductor.

According to the invention, at least one segment of the outer housing is reshaped along the longitudinal axis in such a way that the electrical cable is fixed inside the outer housing.

Since the connecting element according to the invention can consist of a tubular outer housing that can be manufactured in any desired manner and a commercially standard electrical cable or cable blank held inside the outer housing, it can, in contrast to the known, turned connecting element of the prior art, be manufactured economically. The connecting element according to the invention can thus, in particular, be suitable for large-scale manufacture.

As a result of the fact that the outer housing is reshaped according to the invention, i.e. plastically brought into a different shape in a targeted manner without material thereby being removed from or added to the outer housing, a high mechanical holding force of the electrical cable inside the outer housing can be provided in spite of high manufacturing tolerances of the outer housing and/or of the electrical cable which may be present. An outer housing and/or an electrical cable that has comparatively large manufacturing tolerances can thus, in particular, be used, since a corresponding play between the outer housing and the electrical cable can be compensated for through the subsequent reshaping.

Furthermore, the electrical matching for the transmission of signals in the high-frequency range may also be optimized through the reshaping.

The connecting element can advantageously be used, in particular for the transmission of electrical signals in high-frequency technology. Fundamentally, however, the connecting element can be suitable for any signal and/or energy transmissions in the entire field of electrical engineering.

The connecting element according to the invention is preferably suitable for the mechanical and electrical connection of two circuit boards. Fundamentally, the connecting element according to the invention can, however, also be provided for the mechanical and electrical connection of other electrical or electronic assemblies, for example for connecting together control devices, filters, antennas or other modules. For the sake of simplicity, the invention will be described below for the electrical and mechanical connection of two circuit boards. The term "circuit board" can, however, be applied by an expert without difficulty to any desired electrical or electronic assembly, and be correspondingly substituted.

Within the scope of the invention, the outer housing of the connecting element can serve as the outer conductor of the connecting element in the transmission of electrical signals between the circuit boards by means of the inner conductor of the electrical cable.

In a development of the invention it can be provided that the outer housing comprises at the ends a plug-in connector for connecting to a respective mating plug-in connector of an electrical assembly, in particular a circuit board.

In a particularly simple embodiment, preferred in particular for connecting circuit boards, the plug-in connector at the ends of the outer housing can also be designed in that the ends of the outer housing are widened and a plug-in connector is formed thereby. In appropriate cases the inner conductor of the electrical cable can protrude out of the dielectric, starting from the ends in a forward segment suitable for the contacting, or the dielectric can be removed in this forward segment.

The plug-in connector at the respective ends of the outer housing can also be referred to as the "head" of the connecting element, and the region lying between the plug-in connectors as the "adapter".

The plug-in connectors formed at the ends of the outer housing can be designed as interfaces for connecting to arbitrary other plug-in connectors or mating plug-in connectors.

The plug-in connectors at the ends of the outer housing are preferably designed to be round and coaxial. Through the plug-in connection between a plug-in connector and a respective mating plug-in connector, the connecting element can be connected mechanically and electrically to the corresponding circuit board (or to another, arbitrary, electrical assembly).

The connecting element, the outer housing and/or the inner conductor can also pass through a cut-out in at least one of the circuit boards and for example be fixed or connected to the side of the circuit board that lies opposite to the inlet side.

It can also be provided that the inner conductor and/or the outer housing of the connecting element is connected directly to the respective circuit board or to an electrical component, a strip line or a solder pad through soldering, crimping, pressing or another connecting technique. The use of a plug-in connector on one side and a direct connection on the other side can also be provided. The specific connecting method is not important in the context of the invention. The use of plug-in connectors and mating plug-in connectors is, however, particularly advantageous.

The connecting element can thus be electrically conductively connected, in particular to a first circuit board at a first end and to a second circuit board at a second end, in order to form an electrical path. The electrical path can be used for the transmission of electrical signals, in particular high-frequency signals, and/or for electrical power transfer.

It can be provided in one development that the electrically conductive material of the outer housing is non-magnetic. Preferably the electrically conductive material of the outer housing is formed of a non-magnetic metal, particularly preferably of brass.

The term "non-magnetic" refers to a material on which a magnetic field has almost no effect or none at all. The property of only being magnetically influenced to a negligible degree is, amongst other things, also referred to as "amagnetic" or "unmagnetic". The material is preferably not ferromagnetic. In particular, the magnetic properties of non-ferrous metals, or metals without iron, in particular brass or tin bronze, have been found to be particularly suitable in the context of high-frequency simulations according to the invention. Other materials, in particular, however, non-magnetic or weakly magnetic metals, including for example various stainless steels, can also be provided.

It can be provided in a development of the invention that the electrical cable is concentric and, preferably, is designed as precisely one inner conductor and a dielectric that forms the cable jacket.

An electrical cable can also be provided which, in addition to an inner conductor, also comprises an outer conductor, wherein the inner conductor and the outer conductor are separated by an insulator, and the electrical cable further comprises a cable jacket, or the "dielectric" according to the invention, surrounding the outer conductor.

Since a single transmission channel is to be provided as a rule by each connecting element for the connection between electrical circuit boards, the use of an electrical cable that is formed of precisely one inner conductor and one dielectric or cable jacket surrounding the inner conductor has however been found to be particularly suitable.

A concentric structure is in particular suitable for use in high-frequency technology.

It can also, however, be provided in one embodiment of the invention that the electrical cable comprises at least one inner conductor pair for differential signal transmission.

The inner conductor pair can, in particular, run along the longitudinal axis of the connecting element or of the cable in a twisted manner (like a "twisted pair" cable). The inner conductor pair can, however, also run parallel ("parallel pair").

When a plurality of inner conductors are used, the respective inner conductors can each be individually insulated from one another, in particular surrounded by a respective insulator. The dielectric according to the invention can then enclose the plurality of inner conductors altogether, for example in the manner of a cable jacket.

One individual inner conductor pair, or also a plurality of inner conductor pairs, for example two, three, four or even more inner conductor pairs, can then be provided for differential signal transmission.

It can be provided that a plurality of segments of the outer housing are reshaped along the longitudinal axis of the outer housing, wherein the segments can be arranged distributed along the longitudinal axis and/or radially on the outer surface of the outer housing, for example in the manner of notches.

In a particularly preferred development of the invention, it can, however, be provided that the outer housing is reshaped along precisely one contiguous segment of the outer housing.

When, in particular, the connecting element is used for the transmission of high-frequency or high-bit-rate signals, a uniform reshaping and, in particular, a reshaping of a longest possible contiguous segment, can be advantageous in order to transmit the electrical signals without disturbance, in particular without reflection.

A securing or mechanical fixing of the electrical cable by means of notches can, for example, represent a location of electrical disturbance, which can be avoided to the best extent possible through a reshaping of a single segment which preferably extends between the plug-in connectors of the connecting element.

In one embodiment of the invention, it can be provided that the at least one contiguous segment along which the outer housing is reshaped extends at least along fifty percent (50%) of the total length of the outer housing, preferably at least along seventy five percent (75%) of the total length of the outer housing, particularly preferably at least along ninety percent (90%) of the total length of the outer housing and, most particularly preferably, completely or over the full length between the plug-in connectors of the outer housing.

The values mentioned above taken up by the at least one contiguous segment preferably along the total length of the outer housing can be achieved through a single contiguous segment or also distributed over a plurality of segments. The formation of a contiguous single segment is, nevertheless, to be preferred.

Preferably the segment along which the outer housing is reshaped extends centrally between the plug-in connectors of the outer housing, or centrally between the two ends of the outer housing.

For the provision of a connecting element that is as free as possible of disturbance sites, and thus particularly suited for high-frequency technology, it is particularly advantageous to reshape the outer housing along a contiguous segment that extends fully between the plug-in connectors of the outer housing.

A transition region with variable outer diameter can be provided between the plug-in connectors, in particular round plug-in connectors with a first diameter and the reshaped segment of the outer housing with a second diameter.

It can be provided in a preferred development of the invention that the at least one segment of the outer housing is reshaped in such a way that the cross section of the outer housing exhibits, in the reshaped segment, a perimeter that is not circular.

Preferably the basic shape of the tubular outer housing or its cross section is circular, or the perimeter forms a circle (also referred to as the circle edge), and is at least brought into a different shape in the at least one segment through the reshaping. A round geometry, or a circular perimeter is, due to the uniform distance of the wall of the outer housing from the inner conductor, particularly suitable for use in high-frequency technology, for which reason a circular basic shape can be particularly preferred as the starting point for the outer housing.

In a further development it can be provided that the cross section in the reshaped segment comprises two, three, four, five, six or more angular segments uniformly distributed along the perimeter with a uniform, preferably constant radius and/or a uniform arc length.

It can be provided that the angular segments distributed along the perimeter have a uniform radius and/or a uniform arc length.

Preferably the angular segments have a constant radius. The radius of the angular segments can, however, also be variable along the perimeter of the angular segment, for example following an elliptical shape.

While a design of the angular segments with uniform radii and uniform arc lengths is to be preferred, a fixing of the electrical cable with adequate transmission properties can, however, also already result if the angular segments have a uniform radius or a uniform arc length.

Other variants of this which also lead to a fixing of the cable inside the outer housing and can ensure adequate transmission properties are again presented below. It is nonetheless to be preferred if the angular segments have a uniform radius, preferably a constant radius and a uniform arc length.

Through this, the connecting element is brought into a shape in the at least one segment that has a cross-section geometry, while the angular segments have exceptional high-frequency transmission properties as a result of the coaxial configuration. Between the angular segments with the same, preferably constant radius and the same arc length, respective (compensating) angular segments that absorb material displaced from the angular segments with the same radius and the same arc lengths during the reshaping process can be provided. It has been found that the (compensating) angular segments only impair the electrical transmission properties of the connecting elements to a negligible degree.

The fixing of the electrical cable with the aid of the angular segments each of which has a uniform radius and a uniform arc length nevertheless yields a high holding force, permits a simple manufacture, and, as already explained, has outstanding high-frequency transmission properties. Preferably, precisely three angular segments with a uniform, preferably constant radius and a uniform arc length are provided distributed along the perimeter, between each of which (compensating) angular segments are formed.

The angular segments are preferably identical in design, and have an identical, constant radius and a uniform arc length. It is, however, also possible that the angular segments respectively only have one uniform, constant radius or each have one uniform arc length.

It can further be provided in one embodiment of the invention that the angular segments have an identical but nevertheless not constant radius. The angular segments can, for example, follow a course along their arc length or along the perimeter included therein that does not correspond to a constant radius. An elliptical course, for example, or another course can be provided.

In a further embodiment of the invention it can be provided that the angular segment follows different courses along the perimeter or along the arc, which means, for example, that a part of the angular segments has a constant radius and another part has a variable radius. With this embodiment it is particularly advantageous if the different angular segments are arranged symmetrically, for example in such a way that the angular segments with deviating courses are each arranged in alternation. It can also be provided that the angular segments are arranged in pairs in such a way that two identical angular segments are always located, laterally inverted, opposite one another.

The angular segments can, analogously, also have different arc lengths, wherein the angular segments are again preferably arranged symmetrically, for example in such a way that angular segments with deviating arc lengths are arranged in alternation and/or that angular segments with identical arc lengths are arranged in pairs and are arranged, laterally inverted, about the longitudinal axis of the connecting element.

It can be provided in one embodiment of the invention that the at least one segment of the outer housing is reshaped in such a way that the cross section of the outer housing exhibits, in the reshaped segment, a perimeter that corresponds to a constant-width curve, preferably a Reuleaux triangle.

A "constant-width curve" is a curve of constant width, whose closed line always, in any orientation, touches all four sides of a corresponding enclosing square.

This results in a specific geometry of the outer housing which ensures a high mechanical holding force with, nevertheless, an adequately coaxial configuration to ensure good signal transmission—in particular for high-frequency technology.

A constant-width geometry can bring about particularly good electrical properties, since in this way regions at a precise distance from the inner conductor can ensure an appropriate electrical matching. In the corner regions, the volume variation of the insulating part or of the dielectric and the diameter variation of the outer housing can be compensated for without inappropriately distorting the electrical matching.

In principle, a constant-width curve with a higher number of side faces than there are in a Reuleaux triangle, can also be provided. A constant-width curve with four, five, six, seven, eight or even more side faces can, for example, be provided.

A constant-width curve with only two side faces, similar to an ellipse, can however also be provided. As a rule, however, this geometry is not preferred.

It can be provided in one embodiment of the invention that the outer housing is reshaped through stamping or pressing or rolling.

According to one advantageous further development it can in particular be provided that when, in the segment or segments, the outer housing is radially stamped or rolled in such a way that at each of three perimeter segments distributed along the perimeter at uniform, equidistant angular spacings, three perimeter segments arranged with a distance from one another with a uniform, preferably constant radius and uniform arc length are formed.

As the inventors have ascertained, a high holding force with, at the same time, exceptional high-frequency transmission properties results from such an embodiment.

Preferably, three stamping jaws or stamping punches which, in an appropriate stamping or pressing process, convert the originally round cross-section geometry of the outer housing into the cross-section geometry with a constant width curve, in particular the Reuleaux triangle, are used.

In principle, a connecting element with a cross-section geometry which has a coaxial configuration in at least three angular segments, i.e. angular segments with constant radius, can be provided. In these regions, the connecting element can have exceptional transmission properties for high-frequency technology. The inventors have recognized that the slight impairment to the coaxial configuration in the other segments only impairs the electrical performance of the whole connecting element to a negligible degree.

The total diameter of the connecting element in the segment A can, for example, be between two millimeters and eight millimeters (2 mm and 8 mm), preferably two point five millimeters and four millimeters (2.5 mm and 4 mm), particularly preferably about three millimeters (3 mm). The diameter of the electrical cable can, for example, be between one millimeter and seven millimeters (1 mm and 7 mm), preferably one point five millimeters and two point five millimeters (1.5 mm and 2.5 mm), particularly preferably about one point eight millimeters (1.8 mm). The diameter of the inner conductor can, for example, be between zero point five millimeters and one millimeter (0.5 mm and 1 mm), preferably about zero point seven millimeters (0.7 mm). The length of the connecting element can, for example, be between seven millimeters and sixty millimeters (7 and 60 mm), preferably seven millimeters and twenty millimeters (7 and 20 mm), particularly preferably about ten millimeters (10 mm). Fundamentally, however, the expert can design the dimensions of the connecting elements in any desired way, in particular in the light of the respective application and the distance between the circuit boards or electrical assemblies that are to be connected.

The invention further relates to an assembly connection for connecting a first electrical assembly and a second electrical assembly comprising a connecting element, as presented above and below, and two mating plug-in connectors that are designed for connection to the ends of the connecting element and for connecting respectively to an electrical assembly.

To connect a first electrical assembly to a second electrical assembly, each of which preferably is a circuit board, the assembly connection is mounted in such a way that at first the mating plug-in connectors are each connected to an electrical assembly, preferably soldered or crimped or pushed on, and the connecting element, which is preferably provided at each of its ends with a plug-in connector, is then inserted into the mating plug-in connector.

A plurality of assembly connectors can here be provided for connecting a first electrical assembly to a second electrical assembly.

It is also possible in the scope of the invention that one or both mating plug-in connectors are first connected to the connecting element and the connection to an electrical assembly then takes place making use of the mating plug-in connector.

The invention also relates to a circuit board arrangement comprising at least one first circuit board and a second circuit board, wherein the circuit boards are arranged running parallel to one another in different planes.

The surfaces of the circuit boards that can be populated with electrical components in particular run parallel to one another.

The circuit board arrangement can comprise an arbitrary number of circuit boards, although at least two. Even though the invention is described below by way of illustration primarily for the connection of two electrical circuit boards, the circuit board arrangement can, however, also comprise three circuit boards, four circuit boards, five circuit boards or even more circuit boards.

The circuit boards that are to be connected to one another are preferably arranged parallel to one another on different planes. A deviation from the parallel arrangement, resulting from tolerances, for example of up to ten degrees (10°), preferably of up to five degrees (5°) and particularly preferably of up to four degrees (4°) is, in particular, here deemed to be covered by the term "parallel".

The circuit boards can lie directly against one another or, preferably, be spaced apart from one another, in particular having a gap between them.

According to the invention, the circuit board arrangement comprises at least one connecting element arranged between the circuit boards in order to connect the circuit boards to one another electrically and mechanically. The connecting element comprises a rigid, tubular outer housing made of an electrically conductive material and an electrical cable running inside the outer housing along a longitudinal axis of the outer housing. The electrical cable comprises at least one inner conductor and a dielectric surrounding the at least one inner conductor. At least one segment of the outer housing is reshaped along the longitudinal axis of the outer housing in such a way that the electrical cable is fixed inside the outer housing.

A reshaping of the outer housing can, in particular, be advantageous since, as a result of tolerances in an economical manufacture of the outer housing and/or of the electrical cable, a press-fit between said items is under some circumstances not possible, or can lead to an inadequate mechanical holding force or an electrically unsuitable asymmetry. Through the reshaping according to the invention, the component tolerances can have neither a deleterious effect on the mechanical holding force nor a significant effect on the electrical matching, which enables a stable mechanical connection of the circuit board arrangement and a good signal transfer between the circuit boards with, at the same time, economical manufacture of the individual components.

The connecting element (without mating plug-in connector) can also be referred to as an adapter piece or "bullet", and is connected with its respective ends to the respective circuit board or plugged into a corresponding mating plug-in connector of the circuit board, or directly into the circuit board.

With the circuit board arrangement, at least one connecting element can be provided for connecting the circuit boards, but in principle an arbitrary number of connecting elements can be provided, for example two (2 ea.) connecting elements, three (3 ea.) connecting elements, four (4 ea.) connecting elements, five (5 ea.) connecting elements, ten (10 ea.) connecting elements, fifty (50 ea.) connecting elements, one hundred (100 ea.) connecting elements or even more connecting elements. Fundamentally, the expert can specify the number of connecting elements used depending on the number of electrical signals to be transferred, for example the number of necessary channels.

The invention further relates to a method for the manufacture of a connecting element for connecting a first electrical assembly to a second electrical assembly, after which an electrical cable comprising at least one inner conductor and a dielectric surrounding the at least one inner conductor is inserted along a longitudinal axis into a rigid, tubular outer housing. The outer housing is manufactured of an electrically conductive material, wherein at least one segment of the outer housing is reshaped along the longitudinal axis after the insertion of the electrical cable in such a way that the electrical cable is fixed inside the outer housing.

A reshaping and bonding method is thus provided for the construction of connecting elements for a circuit board arrangement.

Preferably the inner diameter of the outer housing is designed to be larger than the outer diameter of the electrical cable. A particularly easy introduction or insertion of the electrical cable into the outer housing can be enabled in this way (clearance fit). The outer diameter of the deep-drawn part can, for example, be zero point one percent to five percent (0.1% to 0.5%) greater than the outer diameter of the electrical cable, for example also by up to one percent (1%), two percent (2%), three percent (3%), five percent (5%) or even more than the outer diameter of the electrical cable.

When mounting a connecting element, a cable blank or an electrical cable can be bonded with a preferably drawn tube. Preferably the bonding process can take place with clearance fit, after which the tube or the outer housing is then radially swaged. The cross section resulting from the reshaping can here be designed in particular in such a way that both the mechanical as well as the electrical properties of the connecting element are optimized. High-frequency simulations can, for example, be used in advance for this purpose.

Through the optimization of the electrical properties of the connecting element with simultaneously a high mechanical holding force of the electrical cable inside the outer housing, a connecting element with a particularly fast and disturbance-free data transmission can be provided according to the invention. The construction of the connecting element can, further, be economical and thus suitable for mass production.

In particular, since a fixing of the electrical cable inside the outer housing takes place through its reshaping, chips, shavings or other abrasive damage can also not occur at the dielectric during the manufacture of the connecting element.

Preferably the electrical cable is manufactured from precisely one inner conductor, in particular a metallic inner conductor which is then overmolded with a non-conductive material or a dielectric. The electrical cable can, in principle, also comprise yet further inner conductors. A concentric cable is preferably used.

The outer housing is preferably manufactured from a non-magnetic material, particularly preferably from brass.

It can be provided in one development that the outer housing is deep-drawn, extruded or turned from a metal blank.

Deep-drawing of the outer housing has, in particular, been found to be particularly advantageous, since the outer housing in this case can be manufactured relatively economically and, as a result of the reshaping according to the invention for fixing the electrical cable, the large tolerances or deviations from the specified dimension that may result from the deep-drawing are not particularly relevant.

In a further development it can be further provided that the at least one segment of the outer housing is reshaped through stamping and/or rolling.

In principle, however, any desired reshaping process, or any desired reshaping technology can be provided, including for example bending. A stamping or rolling technique is, however, particularly suitable. Due to the subsequent reshaping of the outer housing, the electrical cable can also be joined with larger diametric tolerances, wherein a good mechanical fastening as well as an optimum electrical design can also result.

An axial rolling process, i.e. a rolling along the longitudinal axis of the outer housing, can be provided.

A radial rolling process can, however, also be provided, in which rolling takes place radially or tangentially along the outer perimeter of the outer housing.

It can, in principle, be provided that the segment of the outer housing is reshaped through longitudinal rolling, forge rolling, transverse rolling, ring rolling and/or cross rolling.

It can be provided in one embodiment of the method that the at least one segment of the outer housing is reshaped through stamping while using two or more stamping jaws, preferably three or more stamping jaws. The reshaping is preferably done in such a way that the cross section of the reshaped segment corresponds to a constant-width curve, preferably to a Reuleaux triangle.

The number of stamping jaws preferably corresponds to the number of side faces of the constant-width curve; thus, for example, three stamping jaws are provided for reshaping the cross section into a Reuleaux triangle.

The cross section of the outer housing can comprise both regions that are very precisely defined by the closed stamping punch or stamping jaws and in which the mechanical and electrical properties dominate, as well as regions that compensate for the component tolerances and the clearance fit.

Other suitably designed pressing or stamping tools can also be used in the place of stamping jaws or stamping punches.

In one development it can, in particular, be provided that the at least two stamping jaws each comprise a central region that forms a stamping surface, the course of which corresponds to the course of the perimeter of the cross section of the outer housing after the stamping, and wherein the course of the stamping jaws in the outer regions around the central region is in each case set back toward the outside in order to accept material of the outer housing displaced by the stamping during the stamping process.

A region set back with respect to the central region of the cross section of the stamping jaws is, in particular, suitable for accepting material of the outer housing that is displaced as a result of tolerances.

The stamping punch, or each stamping jaw, can thus have a curvature in the central region, wherein the curvature corresponds to the curvature in the respectively adjacent region of the outer housing at the end of the stamping process.

In a further development it can be provided that the outer housing in the segment or segments is radially stamped or rolled at each of three perimeter segments distributed uniformly along the perimeter in such a way that the three perimeter segments arranged at a distance from one another are formed with a uniform, preferably constant radius and uniform arc lengths, wherein a compensation segment is formed between each two perimeter segments which accepts material displaced from the stamped or rolled perimeter segments.

The compensation segment, also already referred to above as the (compensation) perimeter segment, makes it possible that material displaced during the stamping or rolling process can escape. The stamping jaws or stamping punches can be designed accordingly.

It can be provided that all the stamping jaws have the same curvature in their central region, so that angular segments with a uniform, preferably constant radius and uniform arc length are formed. The radius does not necessarily have to be constant. Other curvatures are also possible here; an elliptical course can, for example, be provided. A constant radius is, nevertheless, to be preferred, in order to achieve particularly good electrical transmission properties.

The stamping jaws can, potentially, also be designed in such a way that the arc lengths of the angle segments are not of equal length. The stamping jaws are, preferably, at least arranged such that they stamp or press the outer housing symmetrically, so that the cross sectional surface of the outer housing in the stamped or pressed region has a symmetrical form.

The connecting element according to the invention is preferably suitable for the transmission of high-frequency signals. The connecting element can, however, in principle, also be used for the transmission of low-frequency signals or for the transmission of electrical supply signals.

Features that have already been described in relation to the connecting element according to the invention can of course also advantageously be applied to the assembly connection, the circuit board arrangement and the manufacturing method—and vice versa. Advantages that have already been mentioned in relation to the connecting element according to the invention can furthermore also be understood in terms of the assembly connection, the circuit board arrangement and the manufacturing method—and vice versa.

It should, in addition, be noted that terms such as "including", "comprising" or "with" do not exclude any other features or steps. Terms such as "a" or "the" that refer in the singular to steps or features do not, furthermore, exclude a plurality of steps or features—and vice versa.

Exemplary embodiments of the invention are described in more detail below with reference to the drawings.

The drawings show preferred exemplary embodiments in which individual features of the present invention are illustrated in combination with one another. In light of the present disclosure it will be appreciated that features of one exemplary embodiment can also be implemented when separated from the other features of the same exemplary embodiment and can, accordingly, be combined without difficulty into further useful combinations and subsidiary combinations with features of other exemplary embodiments.

The figures schematically illustrate preferred exemplary embodiments in which individual features of the present invention are illustrated in combination with one another. In light of the present disclosure it will be appreciated that features of an exemplary embodiment can also be implemented separately from the other features of the same exemplary embodiment and can therefore be readily combined with features of other exemplary embodiments to provide further useful combinations and sub-combinations.

Like items are provided with like reference numerals in the various figures of the drawings, of which the following are brief descriptions.

DETAILED DESCRIPTIONS OF PREFERRED EMBODIMENTS

Figure 1:
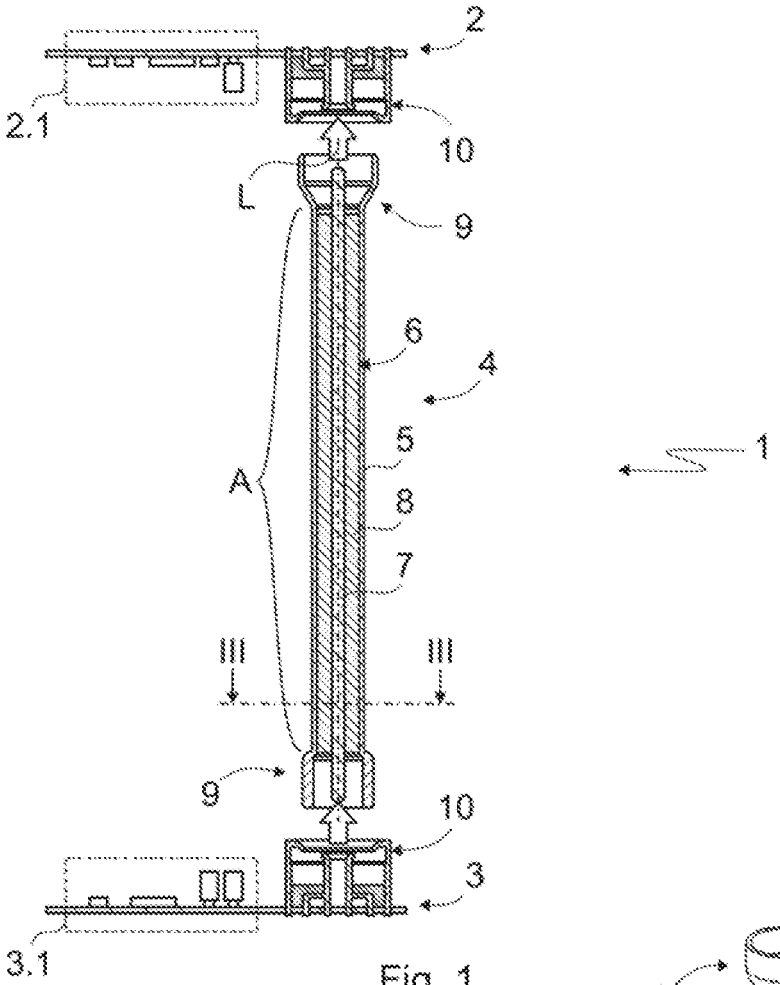
FIG. 1 is a sectional view illustrating an embodiment of of a circuit board arrangement having a first circuit board and a second circuit board as well as a connecting element arranged between the circuit boards.

A cross sectional view of a circuit board arrangement 1 is shown in FIG. 1. The circuit board arrangement 1 comprises a first circuit board 2 and a second circuit board 3 which are arranged running parallel to one another in different planes. In principle, however, further circuit boards can also be provided within the scope of the invention.

A connecting element 4 is arranged between the circuit boards 2, 3, in order to connect the circuit boards 2, 3 together electrically. For reasons of clarity, a state of the connecting element 4 which is not yet plugged together with the circuit boards 2, 3 is shown in FIG. 1.

In principle, an arbitrary number of connecting elements 4 can be provided for the electrical and mechanical connection of the circuit boards 2, 3. The connecting element can, in particular, connect an electrical circuit 2.1 of the first circuit board 2 to an electrical circuit 3.1 of the second circuit board 3.2, in particular for the transmission of high-bit-rate signals between the electrical circuits 2.1, 3.1.

In principle, the connecting element 4 and the assembly connection according to the invention are suitable for the mechanical and electrical connection between arbitrary electrical assemblies, in particular a first electrical assembly and a second electrical assembly. For the purposes of illustration however, only the application of the connecting element 4 in relation to the connection of two circuit boards 2, 3 is described in the exemplary embodiment; i.e. a concrete variant embodiment in which the first electrical assembly is formed as the first circuit board 3 and the second electrical assembly is formed as the second circuit board 4. This is not, however, to be understood as restrictive for the invention.

The connecting element 4 comprises a rigid, tubular outer housing 5 made of an electrically conductive material and an electrical cable 6 running inside the outer housing 5 along a longitudinal axis L of the outer housing 5 or of the connecting element 4. The electrically conductive material of the outer housing 5 can, preferably, be non-magnetic, in particular consisting of a non-magnetic material. Brass is preferably used.

The electrical cable 6 comprises at least one inner conductor 7, in the exemplary embodiment precisely one inner conductor 7, and a dielectric 8 surrounding the inner conductor 7. The electrical cable 6 illustrated in the exemplary embodiments is a concentrically configured electrical cable 6 consisting of precisely one inner conductor 7 and of a dielectric 8 forming a cable jacket. It can, however, also in principle be provided that the electrical cable 6 comprises a plurality of inner conductors 7, for example at least one inner conductor pair, which is preferably provided for differential signal transmission.

The outer housing 5 of the connecting element 4 which serves as the outer conductor of the connecting element 4 has a plug-in connector 9 at each of its ends for connecting to a respective mating plug-in connector 10 of the respective circuit board 2, 3. The inner conductor 7 is thereby also connected to the mating plug-in connector 10. The plug-in connectors 9 of the connecting element 4 are, as illustrated in the exemplary embodiment, preferably round in design.

It is provided in the exemplary embodiment that the plug-in connectors 9 are formed in that the outer housing 5 is widened or has an enlarged diameter at its ends.

The plug-in connectors 9 can, however, also be omitted. The connecting element 4 can then potentially also be inserted directly into the circuit board 2, 3, or connected to the circuit boards 2, 3 by using any desired, suitable connecting technology such as soldering or crimping.

It is provided that at least one segment A, in the exemplary embodiment precisely one segment A, of the outer housing 5 is reshaped along the longitudinal axis L in such a way that the electrical cable 6 is fixed inside the outer housing 5. The segment A can here extend along at least fifty percent (50%) of the total length of the outer housing 5, preferably however along seventy five percent (75%) of the total length of the outer housing 5, particularly preferably at least along ninety percent (90%) of the total length of the outer housing 5, and most particularly preferably all the way between the plug-in connectors 9 of the outer housing 5, as is provided in the exemplary embodiment. If, in particular, the plug-in connectors 9 are omitted, the segment A can also extend all the way along the total length of the connecting element 4.

In principle, however, a reshaping of one or a plurality of segments of the outer housing 5 can also be provided in the form of notches in order to fix the electrical cable 6 inside the outer housing. In the light of the electrical properties that are then impaired, this is not, however, preferred.

Figure 2:
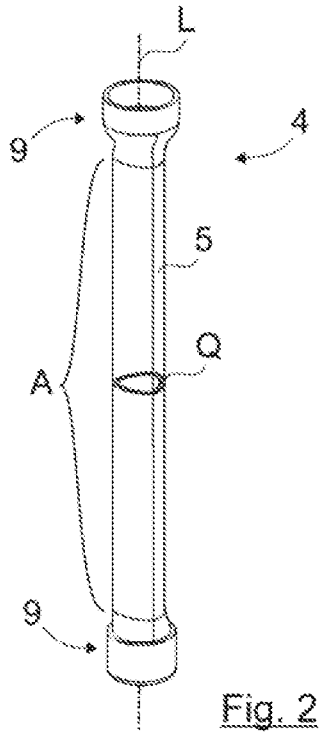
FIG. 2 is an isometric view of the outer housing of the connecting element of the embodiment of FIG. 1.

For the sake of further clarification, FIG. 2 shows an isometric illustration of the outer housing 5 of the connecting element 4 with a graphical emphasis of the cross section Q of the reshaped segment A of the outer housing 5. The cross section Q resulting after the reshaping is further illustrated in FIG. 4.

Fundamentally, a tubular outer housing 5 is provided made of a round, metal blank, wherein the outer housing 5 is preferably deep drawn, extruded or turned from the metal blank. Preferably the at least one segment (A) of the outer housing 5 is then reshaped in such a way that the cross section (Q) of the outer housing 5 in the reshaped segment A is no longer round, or the perimeter no longer follows a circular path (cf. FIG. 2 and FIG. 4). Preferably, the at least one segment of the outer housing 5 is reshaped in such a way that the cross section (Q) of the outer housing 5 follows a constant-width curve in the reshaped segment A, being a Reuleaux triangle in the exemplary embodiment.

From the point of view of an advantageous manufacturing method of the connecting element 4, it is provided that the electrical cable 6 that comprises the at least one inner conductor 7 and the dielectric 8, is inserted along the longitudinal axis L inside the outer housing 5, preferably with adequate pressing clearance, after which the at least one segment A of the outer housing 5 is reshaped along the longitudinal axis L in such a way that the electrical cable 6 is fixed inside the outer housing 5.

The reshaping of the segment (A) of the outer housing 5 can here take place through, for example, stamping and/or rolling (axial or radial). The reshaping preferably takes place through stamping. For the sake of further clarification, FIG. 3 shows the cross section (Q) of the connecting element 4 before the stamping process and FIG. 3 shows the cross section (Q) of the connecting element 4 after the stamping process.

Figure 3:
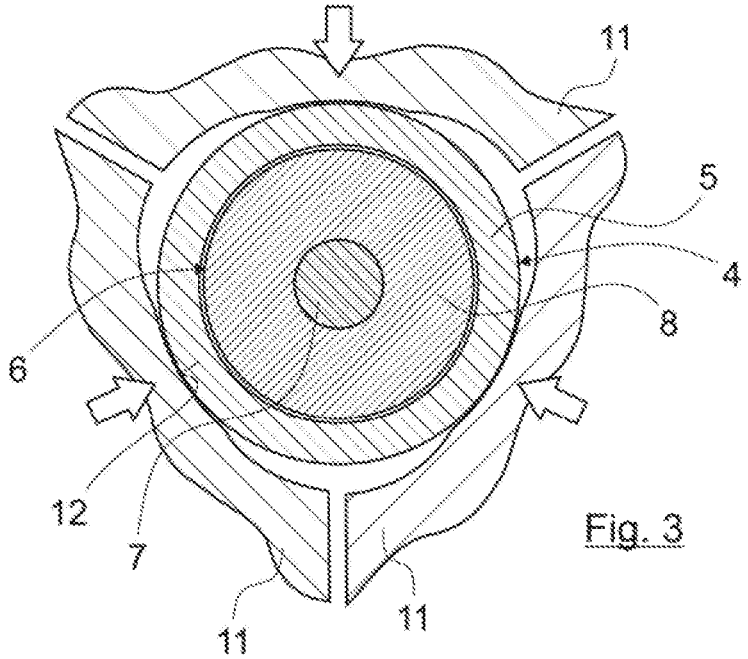
FIG. 3 is cross sectional view of the connecting element of the embodiment of FIG. 1 taken along the plane III of FIG. 1 prior to the reshaping by the stamping jaws.

As can be seen from FIG. 3, the outer diameter of the electrical cable 6 is designed to be smaller than the inner diameter of the outer housing 5 for the sake of easy insertion into the outer housing 5. A clearance between the outer housing 5 and the electrical cable 6 is accordingly present.

Two or more stamping jaws 11 can be provided for fixing the electrical cable 6 by means of an advantageous stamping procedure. Three stamping jaws 11 are preferably provided, as illustrated in the exemplary embodiment, in particular in order to reshape the segment (A) in such a way that the cross section (Q) follows a constant-width curve, for example a Reuleaux triangle, after the reshaping.

The stamping surfaces 12 of the stamping jaws 11 can here correspond in the cross section in a central region $B_M$ (cf. FIG. 4) to the curve of the cross section (Q) of the outer housing 5 after the stamping. The outer regions $B_A$ (cf. FIG. 4) around the central region $B_M$ can each be set back to accept material of the outer housing 5 displaced by the stamping.

Figure 4:
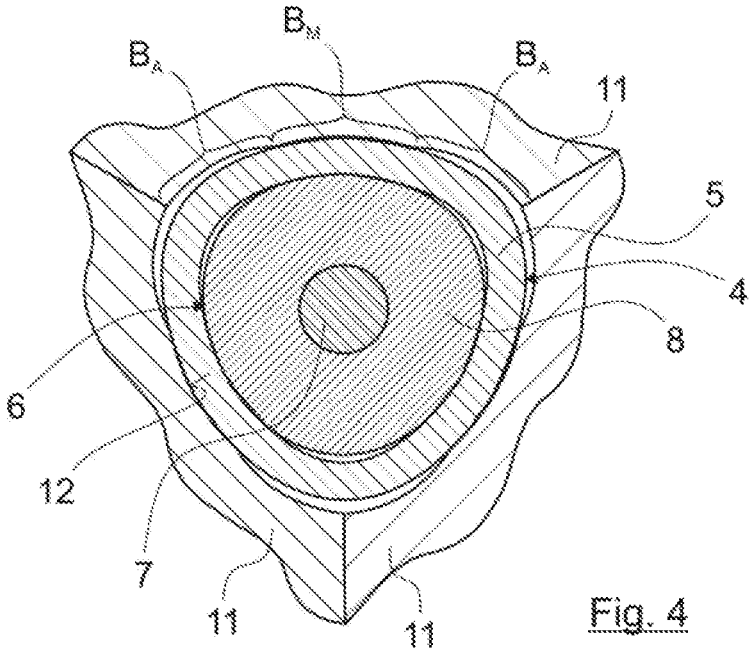
FIG. 4 is a cross sectional view of the connecting element of the embodiment of FIG. 1 taken along the plane III of FIG. 1 after reshaping by the stamping jaws.

As can be seen in particular from FIG. 4, it is provided in the exemplary embodiment that the outer housing 5 is pressed, stamped or rolled radially at three perimeter segments distributed uniformly along the perimeter in such a way that the three perimeter segments, which are arranged at a distance to one another, are formed with a uniform and constant radius and with uniform arc lengths. These are the perimeter segments of the outer housing 5 that formed by the central region $B_M$. A compensation segment is located between each two of these perimeter segments, and accepts material displaced from the pressed, stamped or rolled perimeter segments. The compensation segments are located inside the angular segments of the outer region $B_A$, and are each formed by two adjacent outer regions $B_A$ of two stamping jaws 11 that are adjacent to one another While the invention has been described with reference to various preferred embodiments, it will be understood by those skilled in the art in view of the present disclosure that various changes may be made and equivalents substituted for elements thereof without departing from the scope of the invention. In addition, modifications may be made to adapt to a particular situation or application of the invention without departing from the scope of the invention. Therefore, it is intended that the invention not be limited to the particular embodiments disclosed. Rather, the invention includes all embodiments falling within the scope of the appended claims, either literally or under the Doctrine of Equivalents.

What is claimed is:

1. A connecting element for electrically and mechanically connecting a first electrical assembly having a first mating plug-in connector to a second electrical assembly having a second mating plug-in connector, said connecting element, comprising:

a rigid, tubular outer housing made of an electrically conductive material, the outer housing having a longitudinal axis which extends in a longitudinal direction, the outer housing having a first end and a second end, the first end and the second end being mutually spaced from one another in the longitudinal direction, the outer housing extending continuously from the first end to the second end in the longitudinal direction; an electrical cable running inside the outer housing along the longitudinal axis, the electrical cable extending continuously between the first end and the second end of the outer housing, the electrical cable having at least one inner conductor and a dielectric jacket surrounding the at least one inner conductor, the dielectric jacket surrounding all of the inner conductor except a first longitudinal portion of the inner conductor and a second longitudinal portion of the inner conductor, the first longitudinal portion of the inner conductor protruding longitudinally out of the dielectric jacket and into the first end of the outer housing, the second longitudinal portion of the inner conductor protruding longitudinally out of the dielectric jacket and into the second end of the outer housing; and wherein at least one longitudinal segment of the outer housing is a segment which has been plastically reshaped in such a way as to fix the electrical cable inside the outer housing with a mechanical holding force on the cable, the holding force being a result of the segment of the outer housing having been plastically reshaped, the at least one longitudinal segment being located longitudinally between the first end and the second end of the outer housing; the first end of the outer housing and the first longitudinal portion of the inner conductor together forming a first plug-in connector which is mechanically and electrically connectable directly to the first mating plug-in connector of the first electrical assembly; the second end of the outer housing and the second longitudinal portion of the inner conductor together forming a second plug-in connector which is mechanically and electrically connectable directly to the second mating plug-in connector of the second electrical assembly.

2. A connecting element as claimed in claim 1, wherein the outer housing has a reshaped segment which extends longitudinally all the way between the first plug-in connector and the second plug-in connector.

3. A connecting element as claimed in claim 1, wherein the electrically conductive material of the outer housing is a non-magnetic material.

4. A connecting element as claimed in claim 3, wherein the non-magnetic material is brass.

5. A connecting element as claimed in claim 1, wherein the electrical cable is concentric and consists of only one inner conductor and one dielectric jacket.

6. A connecting element as claimed in claim 1, wherein the segment which has been reshaped has a perimeter which in cross section does not follow a circular path.

7. A connecting element as claimed in claim 6, wherein, in cross section, the segment which has been reshaped comprises at least two angular segments uniformly distributed along the perimeter, each of the segments having a uniform radius.

8. A connecting element as claimed in claim 6, wherein, in cross section, the segment which has been reshaped comprises at least two angular segments uniformly distributed along the perimeter, each of the angular segments having a uniform arc length.

9. A connecting element as claimed in claim 6, wherein, in cross section, the segment which has been reshaped comprises at least two angular segments uniformly distributed along the perimeter, each of the angular segments having a uniform radius and a uniform arc length.

10. A connecting element as claimed in claim 1, wherein the segment which has been reshaped comprises three perimeter segments which are distributed uniformly along a perimeter of a cross section of the outer housing.

11. An assembly connection for connecting a first electrical assembly and a second electrical assembly, said assembly connection, comprising:

a connecting element having a rigid, tubular outer housing made of an electrically conductive material, the outer housing having a longitudinal axis which extends in a longitudinal direction, the outer housing having a first end and a second end, the first end and the second end being mutually spaced from one another in the longitudinal direction, the outer housing extending continuously from the first end to the second end in the longitudinal direction, the connecting element also having an electrical cable running inside the outer housing along the longitudinal axis, the electrical cable extending continuously between the first end and the second end of the outer housing, the electrical cable having at least one inner conductor and a dielectric jacket surrounding the at least one inner conductor, the dielectric jacket surrounding all of the inner conductor except a first longitudinal portion of the inner conductor and a second longitudinal portion of the inner conductor, the first longitudinal portion of the inner conductor protruding longitudinally out of the dielectric jacket and into the first end of the outer housing, the second longitudinal portion of the inner conductor protruding longitudinally out of the dielectric jacket and into the second end of the outer housing; and wherein at least one longitudinal segment of the outer housing is a segment which has been plastically reshaped in such a way as to fix the electrical cable inside the outer housing by a mechanical holding force on the cable, the holding force being a result of the segment of the outer housing having been plastically reshaped, the at least one longitudinal segment being located longitudinally between the first end and the second end of the outer housing; the first end of the outer housing and the first longitudinal portion of the inner conductor together forming a first plug-in connector which is mechanically and electrically connectable directly to the first mating plug-in connector of the first electrical assembly; the second end of the outer housing and the second longitudinal portion of the inner conductor together forming a second plug-in connector which is mechanically and electrically connectable directly to the second mating plug-in connector of the second electrical assembly.

12. A circuit board arrangement, comprising:

a first circuit board and a second circuit board, the first circuit board being located in a first plane, the second circuit board located in a second plane, the first plane and the second plane being parallel to one another; a connecting element electrically connecting the first circuit board and the second circuit board to one another, wherein the connecting element includes a rigid, tubular outer housing made of an electrically conductive material, the outer housing having a longitudinal axis which extends in a longitudinal direction, the outer housing having a first end and a second end, the first end and the second end being mutually spaced from one another in the longitudinal direction, the outer housing extending continuously from the first end to the second end in the longitudinal direction, and wherein the connecting element also includes an electrical cable running inside the outer housing along the longitudinal axis, the electrical cable extending continuously between the first end and the second end of the outer housing, the electrical cable having at least one inner conductor and a dielectric jacket surrounding the at least one inner conductor, the dielectric jacket surrounding all of the inner conductor except a first longitudinal portion of the inner conductor and a second longitudinal portion of the inner conductor, the first longitudinal portion of the inner conductor protruding longitudinally out of the dielectric jacket and into the first end of the outer housing, the second longitudinal portion of the inner conductor protruding longitudinally out of the dielectric jacket and into the second end of the outer housing; and wherein at least one segment of the outer housing is a segment which has been plastically reshaped in such a way as to fix the electrical cable inside the outer housing by a mechanical holding force on the cable, the holding force being a result of the segment of the outer housing having been plastically reshaped, the at least one longitudinal segment being located longitudinally between the first end and the second end of the outer housing; the first end of the outer housing and the first longitudinal portion of the inner conductor together forming a first plug-in connector which is mechanically and electrically connectable directly to the first mating plug-in connector of the first circuit board; the second end of the outer housing and the second longitudinal portion of the inner conductor together forming a second plug-in connector which is mechanically and electrically connectable directly to the second mating plug-in connector of the second circuit board.

13. A connecting element as claimed in claim 1, wherein the segment which has been reshaped comprises three perimeter segments which are arranged a distance from one another on a perimeter of a cross section of the outer housing.

14. A connecting element as claimed in claim 13, wherein the three perimeter segments have a uniform radius.

15. A connecting element as claimed in claim 14, wherein the three perimeter segments have a uniform arc length.

* * * * *